US008162080B2

(12) United States Patent
Castillo

(10) Patent No.: US 8,162,080 B2
(45) Date of Patent: Apr. 24, 2012

(54) APPARATUS AND METHODS FOR CONTINUOUS CORING

(75) Inventor: Homero Castillo, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 75 days.

(21) Appl. No.: 12/235,859

(22) Filed: Sep. 23, 2008

(65) Prior Publication Data

US 2009/0078467 A1 Mar. 26, 2009

Related U.S. Application Data

(60) Provisional application No. 60/975,065, filed on Sep. 25, 2007.

(51) Int. Cl.
*E21B 25/10* (2006.01)

(52) U.S. Cl. ..... 175/249; 175/50

(58) Field of Classification Search ..... 175/332, 175/333, 402, 249, 244, 50, 58
See application file for complete search history.

(56) References Cited

U.S. PATENT DOCUMENTS

| | | | | |
|---|---|---|---|---|
| 2,024,730 | A * | 12/1935 | Hammer | 175/333 |
| 2,975,849 | A | 3/1961 | Stuart | |
| 3,323,604 | A * | 6/1967 | Henderson | 175/244 |
| 3,578,093 | A * | 5/1971 | Elenburg | 175/60 |
| 4,230,192 | A | 10/1980 | Pfannkuche | |
| 4,696,308 | A | 9/1987 | Meller et al. | |
| 4,930,587 | A * | 6/1990 | Young et al. | 175/251 |
| 4,950,844 | A | 8/1990 | Hallmark et al. | |
| 5,297,420 | A | 3/1994 | Gilliland et al. | |
| 5,301,759 | A | 4/1994 | Ruhle | |
| 5,333,686 | A | 8/1994 | Vaughan | |
| 5,360,074 | A * | 11/1994 | Collee et al. | 175/58 |
| 5,439,065 | A | 8/1995 | Georgi | |
| 5,487,433 | A | 1/1996 | Mackay et al. | |
| 5,957,221 | A | 9/1999 | Hay et al. | |
| 5,984,023 | A | 11/1999 | Sharma et al. | |
| 6,003,620 | A | 12/1999 | Sharma et al. | |
| 6,006,844 | A * | 12/1999 | Van Puymbroeck et al. | 175/50 |
| 6,148,933 | A | 11/2000 | Hay et al. | |
| 6,220,371 | B1 | 4/2001 | Sharma et al. | |
| 6,267,179 | B1 | 7/2001 | Ohmer et al. | |
| 6,283,228 | B2 * | 9/2001 | Collee et al. | 175/58 |
| 6,305,482 | B1 * | 10/2001 | Aumann et al. | 175/58 |
| 6,318,466 | B1 | 11/2001 | Ohmer et al. | |
| 6,401,840 | B1 | 6/2002 | Hay et al. | |
| 6,550,549 | B2 | 4/2003 | Myrick | |
| 6,655,220 | B1 | 12/2003 | Reiffsteck | |
| 6,659,204 | B2 | 12/2003 | Aumann et al. | |

(Continued)

FOREIGN PATENT DOCUMENTS

GB 2305679 A 4/1997

*Primary Examiner* — David Bagnell
*Assistant Examiner* — Kipp Wallace
(74) *Attorney, Agent, or Firm* — Cantor Colburn LLP

(57) ABSTRACT

In an aspect, an apparatus may include a chamber configured to receive a core at a receiving end of the chamber and a cutting device configured to cut the core at a location distal from the receiving end of the core chamber. In aspects, a method may include drilling into the formation to retrieve a core, receiving the core into a chamber at an open end of a chamber, and cutting the core uphole of the open end of the chamber so as to continue to receive the core into the chamber as the drilling continues.

16 Claims, 7 Drawing Sheets

U.S. PATENT DOCUMENTS

| | | | |
|---|---|---|---|
| 6,729,416 | B2 | 5/2004 | Contreras et al. |
| 6,788,066 | B2 | 9/2004 | Wisler et al. |
| 6,876,721 | B2 | 4/2005 | Siddiqui |
| 6,905,804 | B2 | 6/2005 | Law et al. |
| 7,168,508 | B2 | 1/2007 | Goldberg et al. |
| 2004/0007387 | A1 | 1/2004 | Bar-Cohen |
| 2005/0199393 | A1 | 9/2005 | Goldberg et al. |
| 2006/0081398 | A1 | 4/2006 | Arian et al. |
| 2007/0107939 | A1 | 5/2007 | Goldberg et al. |
| 2007/0215349 | A1 | 9/2007 | Reid et al. |

* cited by examiner

APPARATUS AND METHODS FOR CONTINUOUS CORING

CROSS-REFERENCE TO RELATED APPLICATIONS

This application takes priority from U.S. Provisional Patent Application Ser. No. 60/975,065, filed on Sep. 25, 2007.

BACKGROUND OF THE DISCLOSURE

1. Field of the Disclosure

The disclosure herein relates generally to obtaining cores from a formation and estimating one or more properties of interest downhole.

2. Description of the Related Art

To obtain hydrocarbons such as oil and gas, wells (also referred to as "wellbores" or "boreholes") are drilled by rotating a drill bit attached at a bottom end of a drill string. The drill string typically includes a tubular member (made by joining pipe sections) attached to a top end of a drilling assembly (also referred to as the "bottomhole assembly" or "BHA") that has a coring drill bit (or "coring bit") at the bottom end of a drilling assembly. The coring bit has a through-hole or mouth of a selected diameter sufficient to enable the core to enter into a cylindrical coring barrel (also referred to as a "liner") inside the drilling assembly. One or more sensors are placed around the core barrel to make certain measurements of the core and of the formation surrounding the wellbore drilled to obtain the core. The length of the core sample that may be obtained is limited to the length of the core barrel, which is generally a few feet long. Such systems, therefore, are not conducive to continuous coring (coring beyond the core barrel length) or for taking measurements of cores longer than the core barrel length. To core for an extended wellbore length, the coring operation is stopped in order to either retrieve the core from the core barrel or to raise the drill string above the top of the core to disintegrate the core with the drill bit before continuing the drilling of the wellbore. It is, therefore, desirable to continuously core and obtain measurements to estimate one or more properties of the core and of the surrounding formation to obtain tomograms of the cores and of the formation, and to selectively store core samples from more than one depth, substantially without stopping the drilling operation.

Therefore, there is a need for an improved apparatus and method for coring and making measurements relating to various properties of the cores and the formation.

SUMMARY

The present disclosure, in one aspect, provides systems, apparatus and methods for continuous or substantially continuous coring of a subsurface formation. In one aspect, a method may include: drilling into a formation to retrieve a core from the formation; receiving the retrieved core into a chamber at an open end of a chamber; and removing a portion of the core uphole of the open end of the chamber so as to continue to receive the core into the chamber as the drilling continues.

An apparatus, according to one embodiment, may include a drill bit that is configured to drill into a formation to retrieve a core from the formation; a chamber that receives the core via an open end of the chamber; a cutting device configured to remove a portion of the core uphole of the open end of the chamber so that the chamber continues to receive the core as the drill bit continues to core the formation. In one aspect, the systems, apparatus and methods allow for continuous coring operations.

In another aspect, apparatus and methods are provided for selectively storing core samples. In one aspect, a method may include: receiving a core via a first end of a first chamber; moving a portion of the core into a second chamber from a second end of the first chamber; cutting the core proximate to the second end of the first chamber; and storing the cut core in the second chamber. The method may further include continuing to cut the core proximate to the second end of the first chamber so as to continue to receive the core into the first chamber. The method may further include repeating the above-noted process to selectively store in the second chamber additional core samples obtained at different formation depths.

In another aspect, systems, apparatus and methods are provided for estimating a property of a core and/or formation and/or the wellbore fluid and/or for performing tomography of a continuously obtained core. In one aspect, a method may include estimating a property of interest of a continuously retrieved core using at least one sensor placed proximate to the core. The estimated property of interest may be utilized to provide a two-dimensional or three-dimensional tomogram of the property of interest of the core.

Aspects of the apparatus and methods disclosed herein have been summarized broadly to acquaint the reader with the subject matter of the disclosure and it is not intended to be used to limit the scope of the concepts, methods or embodiments related thereto of claims that may be made pursuant to this disclosure. An abstract is provided to satisfy certain regulatory requirements and is not to be used to limit the scope of the concepts, methods and embodiments related thereto to the claims that may be made pursuant to this disclosure.

BRIEF DESCRIPTION OF THE DRAWINGS

For detailed understanding of the present disclosure, references should be made to the following detailed description of the apparatus and methods for retrieving cores and estimating one or more properties or characteristics of the core and formation, taken in conjunction with the accompanying drawings, in which like elements have generally been given like numerals, wherein:

FIG. 1 (comprising FIGS. 1A and 1B) is a schematic diagram of a drilling system for coring and estimating one or more parameters of interest of a core and a formation associated therewith, wherein

DETAILED DESCRIPTION OF THE EMBODIMENTS

Figure 1A:
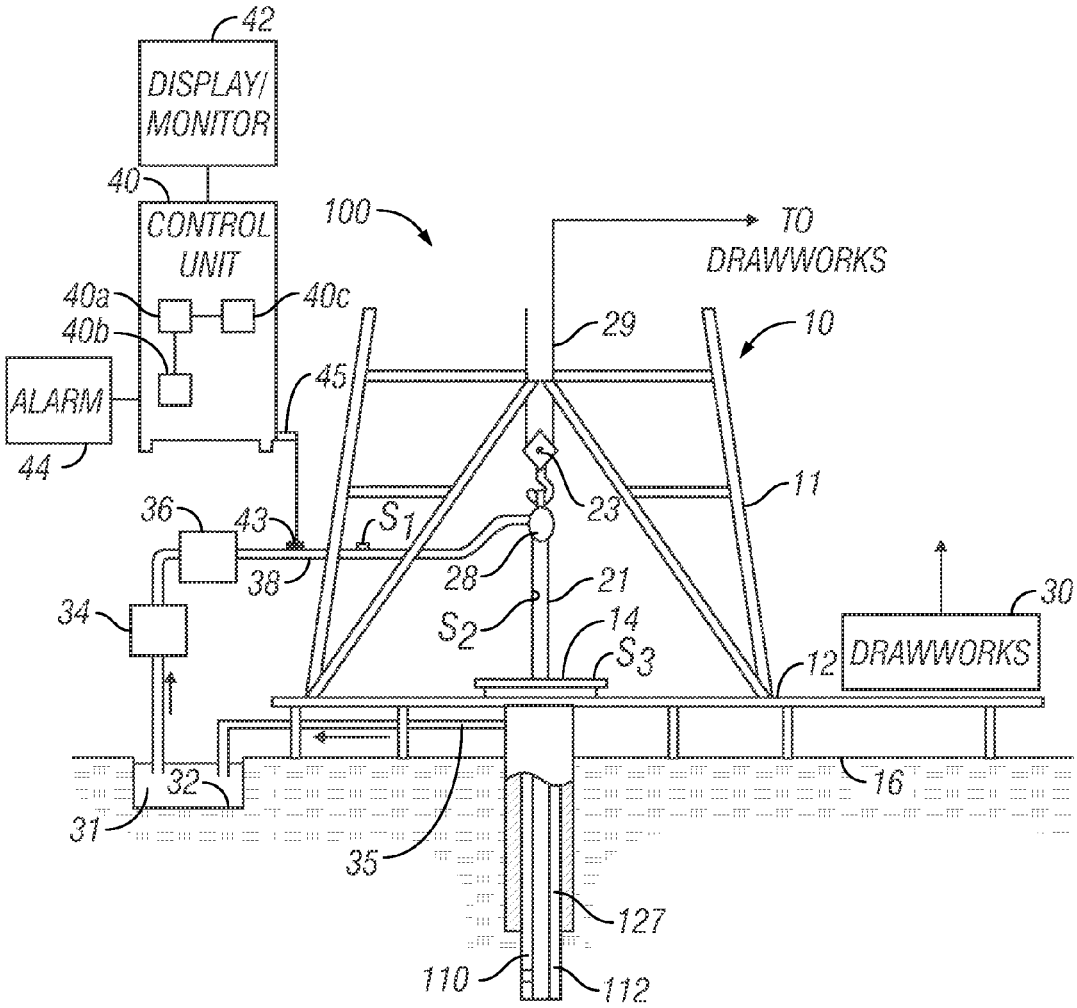
FIG. 1A shows an exemplary surface apparatus and FIG. 1B shows an exemplary downhole apparatus of the drilling system.
Figure 1B:
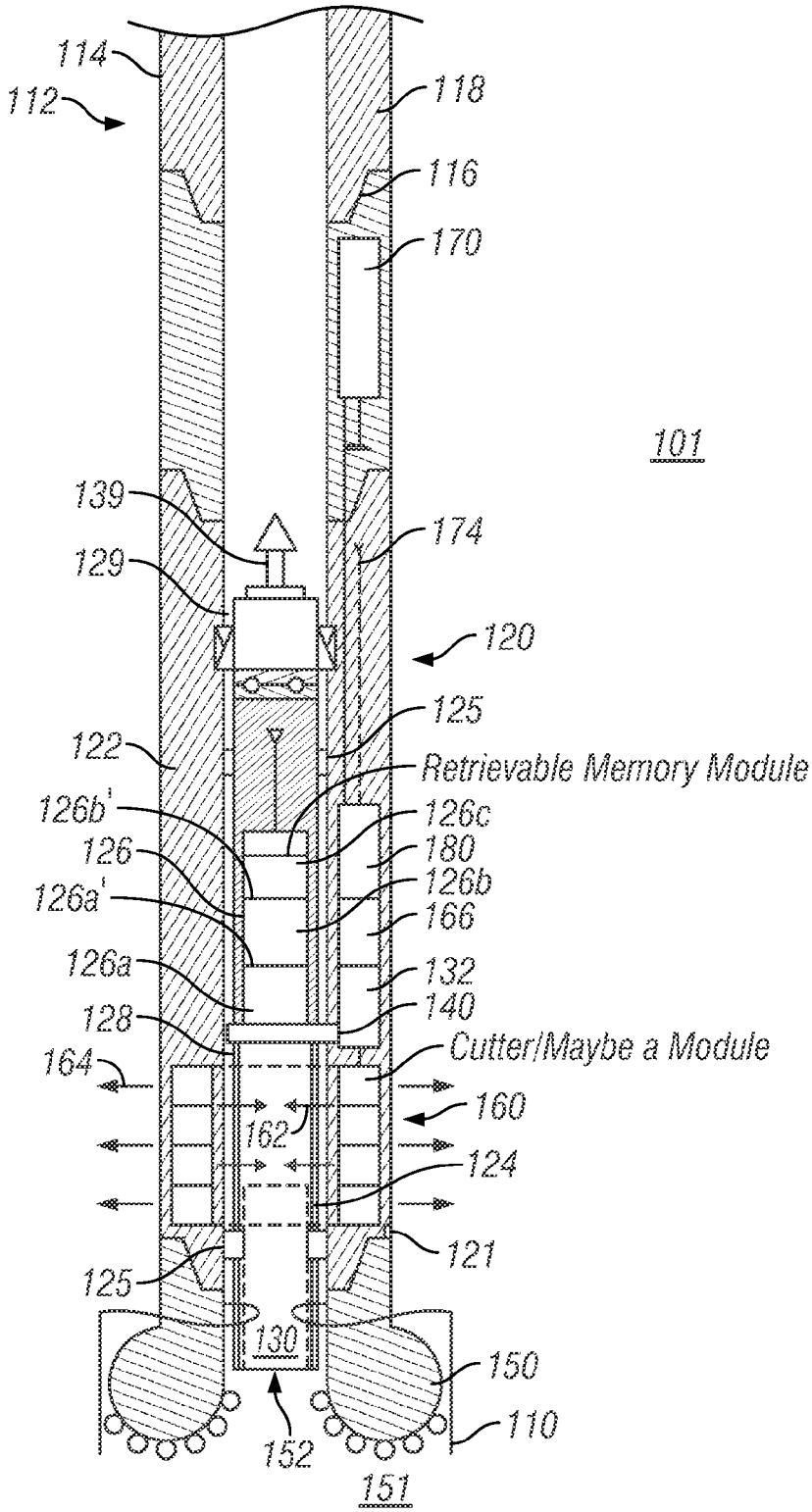

FIG. 1 (comprising FIGS. 1A and FIG. 1B) is a schematic diagram showing an exemplary drilling system 100 that may be utilized for continuous coring, selectively storing core samples, estimating one or more properties of the core and/or estimating formation parameters during drilling of a wellbore 110 according to one aspect of the disclosure. FIG. 1 shows a wellbore 110 being drilled with a drill string 112 in a formation 101. The drill string 112, in one aspect, includes a tubular member 114 and a drilling assembly 120, also referred to as a "bottomhole assembly" or "BHA" attached at its bottom end 118 with a suitable connection joint 116. The tubular member 114 is typically made up by connecting drill pipe sections. A drill bit 150 (also referred to herein as the "coring bit") is attached to the bottom end 121 of the drilling assembly 120 for drilling the wellbore 110 in the formation 101. The drill bit 150 has a through bore or mouth 152 having a diameter substantially equal to the diameter of the core 130 to be obtained. The drill bit 150 is attached to a drill collar 122 of the drilling assembly 120. The drill collar includes an internal barrel or liner 124 for receiving the core 130 therein. The barrel 124 remains stationary when the drilling assembly 120 is rotated to rotate the drill bit 150 to obtain the core 130. Suitable centralizers or support members 125, such as stabilizers, bearings assemblies, etc. may be placed at selected locations between the core barrel 124 and an inside wall 128 of the drilling assembly 120 to provide lateral or radial support to the core barrel 124.

In one aspect, a cutting device (or cutter) 140 may be placed at a selected distance above or uphole the drill bit mouth 152 to cut or disintegrate the core 130 after it has been received in the barrel 124. In one aspect, the cutting device 140 may be configured to grind the top end of the core 130. In another aspect, the cutting device 140 may be configured to cut the core from the core sides. In yet another aspect, the cutting device 140 may be configured to selectively engage the core 130 to cut the core. In another aspect the cutting device 140 may be configured to retract or disengage from the core 130 so that a portion of the core 130 may be moved into a core storage or sample chamber 126 above or uphole of the barrel 124 as described in more detail later in reference to FIGS. 2-5. In one aspect, the cutting device 140 may be configured to continuously remove or cut the top end of the core 130 to enable the core barrel 124 to continuously receive the core 130 as it is extracted from the formation 101. This method allows continuous coring beyond the length of the core barrel 124. A power unit 132 provides power to the cutting device 140. In the configuration shown in FIG. 1B, the cutting device 140 cuts or removes the top end of the core 130 at or above the rate of penetration (ROP) of the drill bit 150 into the formation 101. The cutting device 140 may be any suitable device that can cut the core at the desired rates, including, but not limited to, a mechanical cutter with blades, one or more side drill bits, a cutting device that utilizes high pressure fluid (liquid or gas or a mixture), an explosive device and a laser device. The power unit 132 for a mechanical cutter with blades may be any suitable device, including, but not limited to, an electrical motor, a fluid-operated motor, and a pneumatic motor. A fluid cutting device may include one or more stages for building fluid pressure downhole and the high pressure fluid so generated may be applied to the core 130 via one or more nozzles or jets placed around the barrel 124. A downhole controller or control unit 180 in the drilling assembly 120 may control the operation of the cutting device 140. The controller 180, in one aspect, may include a processor, such as microprocessor, one or more data storage devices (or memory devices) and other circuitry configured to control the operation of the cutting device 140 according to programmed instructions stored in the memory device in the control unit 180 or instructions supplied from the surface. The operation of the cutting device 140 is described in more detail later in reference to FIGS. 2-6.

The storage barrel or chamber 126 is placed above the cutting device 140 to receive the core 130. Multiple cores 126*a*, 126*b*, 126*c* may be stored in the chamber 126, each such core being separated by a separator, such as separators 126*a*' and 126*b*' as described in reference to FIGS. 6A and 6B. A retrieval device 129 placed above the core storage chamber 126 may be provided to retrieve the cores from the chamber 126 via a suitable mechanism 139, such as a wireline, slick line, etc. Such retrieval devices and methods are known in the art and are thus not described in detail herein. The storage chamber 126 may, however, also be used to retain the one or more core samples during drilling, which samples may then be retrieved for analysis after the drilling assembly 120 is tripped out of the wellbore.

The drilling assembly 120 further may include a variety of sensors and devices, generally designated herein by numeral 160, for taking measurements relating to one or more properties or characteristics of the: (i) core 130; (ii) fluid in the wellbore; and (iii) formation 101. The processor in the controller 180 in the drilling assembly 120 and/or the processor in the surface control unit 40 may be configured to perform tomography of the core 130 using the sensor measurements. For the purpose of this disclosure, the term tomography is used in a broad sense to mean imaging of a parameter or characteristic in two or three dimensions. A device used in tomography may be referred to as a tomograph and the image produced as a tomogram. As described later, some of the devices 160 may be utilized to perform measurements on the core 130, as shown by inward arrows 162, some other devices may be used to perform measurements on the formation 101 as shown by the outward arrows 164, while some other devices may be used to perform measurements on the fluid in the wellbore. Additionally, the drilling assembly 120 may include sensors 166 for determining the inclination, position and azimuth of the drilling assembly 120 during drilling of the wellbore 110. Such sensors may include multi-axis inclinometers, magnetometers and gyroscopic devices. The information obtained from sensors 166 may be utilized for drilling the wellbore 110 along a selected wellbore trajectory. The controller 180 also may control the operation of one or more devices 160 and 166. Individual devices may contain their own controllers. A telemetry unit 170 in the drilling assembly 120 communicates with the downhole devices 160 and 166 via a link, such as a data and power bus 174, and establishes a two-way communication between such devices and the surface controller 40. Any suitable telemetry system may be utilized for the purpose of this disclosure, including, but not limited to, a mud pulse telemetry system, an electromagnetic telemetry system, an acoustic telemetry system, and wired pipe system. The wired-pipe telemetry system may include jointed drill pipe sections which are fitted with a data communication link, such as an electrical conductor or optical fiber. The data may also be wirelessly transmitted using electromagnetic transmitters and receivers across pipe joints or acoustic transmitters and receivers across pipe joints.

The drill string 112 extends to a rig 10 (FIG. 1A) at the surface 16. The rig 10 includes a derrick 11 erected on a floor 12 that supports a rotary table 14 that is rotated by a prime mover, such as an electric motor (not shown), at a desired rotational speed to rotate the drill string 112 and thus the bit 150. The drill string 112 is coupled to a drawworks 30 via a Kelly joint 21, swivel 28 and line 29. During drilling operations, the drawworks 30 is operated to control the weight on bit, which affects the rate of penetration. The operation of the drawworks 30 is known in the art and is thus not described in detail herein. During drilling operations a suitable drilling fluid 31 (also referred to as the "mud") from a source or mud pit 32 is circulated under pressure through the drill string 112 by a mud pump 34. The drilling fluid 31 passes into the drill string 112 via a desurger 36 and a fluid line 38. The drilling fluid 31 discharges at the borehole bottom 151. The drilling fluid 31 circulates uphole through the annular space 127 between the drill string 112 and the borehole 110 and returns to the mud pit 32 via a return line 35. A sensor S1 in the line 38 provides information about the fluid flow rate. A surface torque sensor S2 and a sensor S3 associated with the drill string 20 respectively provide information about the torque and the rotational speed of the drill string. Additionally, one or more sensors (not shown) associated with line 29 are used to provide data regarding the hook load of the drill string 112 and about other desired parameters relating to the drilling of the wellbore 110.

The surface control unit 40 may receive signals from the downhole sensors and devices via a sensor 43 placed in the fluid line 38 as well as from sensors S1, S2, S3, hook load sensors and any other sensors used in the system. The processor 40 processes such signals according to programmed instructions and displays desired drilling parameters and other information on a display/monitor 42 for use by an operator at the rig site to control the drilling operations. The surface control unit 40 may be a computer-based system that may include a processor 40*a*, memory 40*b* for storing data, computer programs, models and algorithms 40*c* accessible to the processor 40*a* in the computer, a recorder, such as tape unit for recording data and other peripherals. The surface control unit 40 also may include simulation models for use by the computer to process data according to programmed instructions. The control unit responds to user commands entered through a suitable device, such as a keyboard. The control unit 40 is adapted to activate alarms 44 when certain unsafe or undesirable operating conditions occur.

Figure 2:
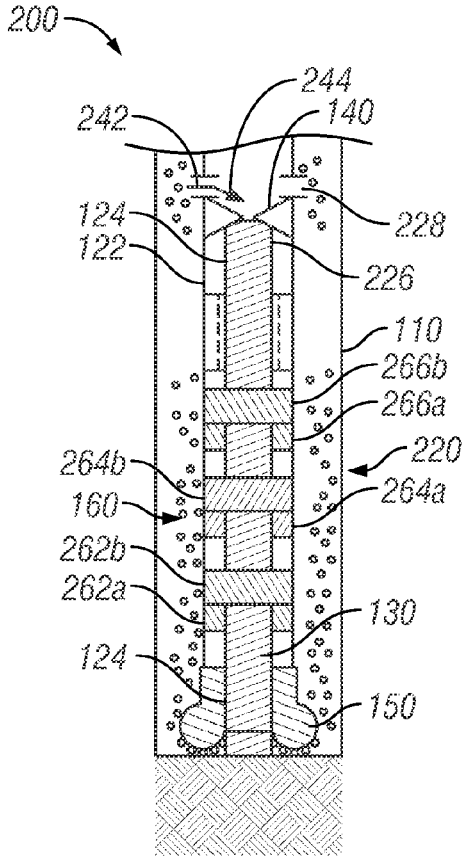
FIG. 2 is a schematic diagram of a portion of a drilling assembly that includes a cutting device for cutting the core while drilling and a plurality of sensors for taking measurements relating to one or more parameters or properties of the core and the formation according to one embodiment of the disclosure.

FIG. 2 is a simplified schematic diagram 200 of a portion 220 of the drilling assembly 120 that may be utilized for, among other things, performing continuous coring, continuous tomography of the core, continuous formation evaluation, and/or in-situ calibration of one or more downhole sensors. FIG. 2 shows the core 130 being received in the core barrel 124 and a cutting device 140 mounted above or adjacent to a top end 226 of the core barrel 124. In this configuration, as the wellbore 110 is drilled, the core 130 is received in the barrel 124. When the core 130 reaches the top end 226 of the core barrel, the cutting device 140 starts to disintegrate a top portion of the core 130, thereby allowing the new or additional core to enter into the core barrel 124 as the drilling continues. The cutter is configured or operated to remove the top end of the core at a rate that is the same or greater than the rate of penetration of the drill bit 150 for continuous coring operations. This allows the core to be received into the core barrel continuously without the need to stop drilling the wellbore 110, thereby allowing continuous coring operations. In one aspect, suitable openings 228 may be provided in the drill collar 122 to discharge the core cuttings into the wellbore 110. In another aspect, fluid 242 under pressure may be discharged on the core cuttings or the cutting device 140 and/or at or near the top of the core 130 to lubricate the blades of a mechanical cutting device and to force the core cuttings out of the area in which the cutting operation is being carried on and into the wellbore or into a channel made in the drill collar 112. Any suitable nozzle 244 attached to fluid source (such as source 132, FIG. 1B) may be utilized to supply the fluid 242. The controller 180 may control the cutting rate of the cutting device 140 and the supply of the fluid 242. In another aspect, the cutting device 140 may be configured to alter the cutting rate based on the ROP of the drill bit 150. In another aspect, the cutting rate of the cutting device may be set sufficiently high to ensure cutting of the core at or above the maximum ROP of the drill bit 150.

Referring to FIGS. 1 and 2, the drilling assembly 120 may be configured to include any number of sensors 160 for estimating one or more properties of interest downhole. As an example, a resistivity sensor 262*a* may be provided to measure an electrical property of the core 130. The resistivity sensor 262*a* may contain electrodes that induce electrical current along a periphery of the core 130 for obtaining a resistivity property of the core and for providing a tomogram thereof. The resistivity sensor may also be an electromagnetic wave propagation device, such as an induction device, to estimate an electrical property of the core, such as impedance, water saturation, etc. Different frequencies may be utilized to investigate different depths of the core 130. Typically, the core diameter is relatively small (5-15 cm) and the analysis by resistivity sensors can provide a three dimensional picture of the properties of interest. In another aspect, a resistivity device 262*b* may be provided to estimate the electrical properties of the formation 101 surrounding the core 130. The sensors 262*a* and 262*b* may be configured to measure the same properties for the core 130 and the formation 101. In one aspect, the values from the sensors 262*a* and 262*b* may be compared and the difference or variance between the two sets of values may be utilized for in-situ calibration of one or both sensors. Thus, the configuration shown FIG. 2 allows continuous coring; enables continuous estimation or determination of one or more properties of the core; enables performing continuous tomography of the core; provides estimates of the same properties of the core and the formation; and allows in-situ calibration of one sensor based on the measurements of another sensor.

In another aspect, an acoustic sensor or device 264*a* may be used to measure one or more acoustic properties of the core 130 and another acoustic sensor 264*b* may be used to measure the same and/or different properties of the formation surrounding the core. Acoustic sensors may be utilized to: image the outside of the core 130 and the inside of the wellbore; estimate acoustic porosity of the core and the formation 101; estimate acoustic travel time, etc. In another aspect a nuclear magnetic resonance ("NMR") device 266*a* may be utilized to estimate permeability and other rock properties of the core 130 and another NMR device 266*b* may be utilized to estimate permeability and other rock properties of the formation 101. Thus, any suitable device or sensor may be utilized to estimate properties and/or tomography of the core. Additionally any suitable sensor may be used to estimate properties of interest of the formation 101. In addition to the devices noted above, drilling assembly 120 may include: sensors to estimate pore saturation, pore pressure, wettability, internal structure of the core; optical devices, including spectrometers, for determining fluid properties and/or fluid composition (such as proportions of oil, gas, water, mud contamination, etc.), absorbance, refractive index, and presence of certain chemicals; laser devices; nuclear devices; x-ray devices, etc. The sensors 160 may also include nuclear sensors (neutron and chemical source based sensors), pressure sensors, temperature sensors, gamma ray and x-ray sensors. The measurements made by such sensors may be processed alone or combined to provide estimates of desired properties of interest, including, but not limited to, tomography, porosity, permeability, bulk density, formation damage, pore pressure, internal structure, saturation, capillary pressure, an electrical property, acoustic properties, geomechanics, and density. The sensors used to obtain properties of interest of the core, such as sensors 262*a*, 264*a*, 266*a*, etc., are also referred to herein as the tomography-while-drilling (TWD) sensors and the sensors used to estimate properties of the formation or wellbore fluids, such as sensors 262*b*, 264*b*, 266*b*, etc., are also referred to herein as the measurement-while-drilling (MWD) sensors or logging-while-drilling (LWD) sensors.

Figure 2A:
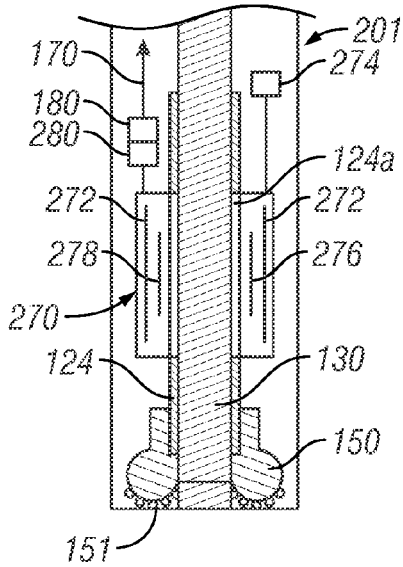
FIG. 2A is a schematic diagram of a portion of a drilling assembly that shows a nuclear magnetic resonance (NMR) sensor disposed around a nonmagnetic portion of a core barrel for taking NMR measurements of the core according to one embodiment of the disclosure.

FIG. 2A is a schematic diagram of a portion 201 of the drilling assembly that shows one exemplary configuration of an NMR sensor 270 placed in the drilling assembly 120 for taking NMR measurements of the core 130. In this configuration, the core barrel 124 includes a non-conductive segment 124*a* to allow the NMR signals to penetrate into the core. The non-conductive segment 124*a* may be made from any suitable material, such as an aramid fiber. The NMR sensor 270 is shown to include a magnet 272 that surrounds the core 130 to induce a constant magnetic field in the core 130. A transmitter circuit 274 transmits electrical signals into the core 130 via a transmitter coil 276 disposed on one side of the core. A receiver coil 278 receives the return signals from the core 130. A processing circuit 280 preprocesses the signals received by the receiver coil 276 and provides digital signals to the downhole controller 180 for further processing. The digital signals may be processed by the downhole controller 180 and/or the surface controller 40 to estimate properties of the core. The NMR sensor 270 may be provided alone or in addition to another NMR sensor that provides similar measurements for the formation 101. One of these sensors may be used to calibrate the other sensor.

Figure 2B:
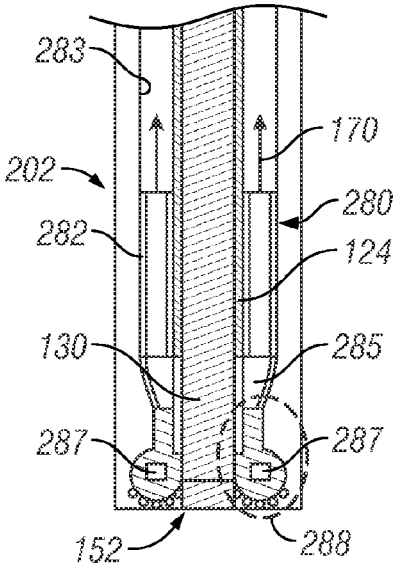
FIG. 2B is a schematic diagram of a portion of a drilling assembly that shows a removable sensor package around a core for taking measurements of one or more properties of the core and/or the formation according to one embodiment of the disclosure.

FIG. 2B is a schematic diagram of a portion 202 of the drilling assembly 120 that shows an exemplary configuration of a removable sensor module 280 that may include one or more sensors for estimating one or more properties of the core 130 and/or the formation 101 surrounding the core 130. In this configuration, there is provided a gap 282 between the core barrel 124 and an inside 283 of the drill collar 122 that is sufficient to accommodate the removable sensor module 280. The sensor module 280 may include any suitable sensor, including any of the sensors discussed herein above. Also, one or more sensors 285 may be provided proximate to the drill bit 150 to obtain measurements of one or more parameters of the formation in front of the drill bit 150. Such sensors are referred to as look-ahead sensors and may include, but are not limited to, a resistivity sensor, an acoustic sensor and a gamma ray sensor. Such sensors also provide information about the formation type, such as sand and shale. Additionally, any suitable sensors 287 may be disposed in the drill bit 150 for providing measurements relating to properties of the drill bit 150, core 130 and/or the formation 101. The resistivity sensor is configured so that an electrical loop 288 is created about the drill bit 150.

Figure 2C:
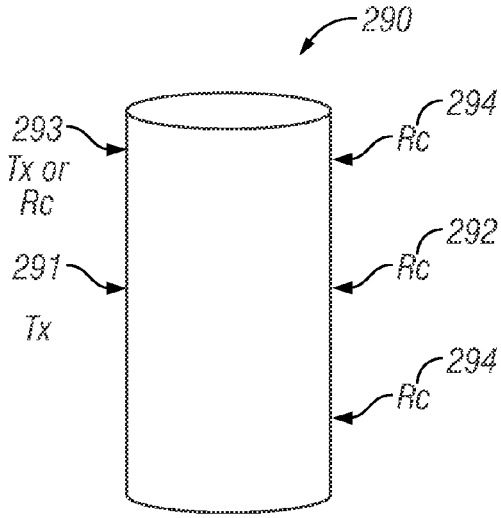
FIG. 2C is a schematic diagram showing placement of acoustic transmitters and receivers for taking acoustic measurement relating to a core according to one embodiment of the disclosure.

FIG. 2C shows acoustic sensor arrangements 290 for estimating acoustic properties of the core 130. In one aspect, a first acoustic transmitter 291 may be used to induce acoustic waves in to the core 130 and a receiver 292 placed radially from the transmitter 291 receives the acoustic waves passing through the core 130 for measuring horizontal acoustic velocity. In another aspect a receiver 293 may be placed axially from the transmitter 291 for estimating the vertical acoustic velocity. In another aspect a receiver 294 may be placed axially from the receiver 292. A single transmitter and a single receiver either axially or radially disposed enable estimating formation slowness in the axial or radial plane either individually or at the same time with multiple receivers. In another aspect additional transmitters and receivers may be placed around the core to estimate azimuthal properties of the core 130. Thus, in aspects, one or more acoustic transmitters may be disposed axially, azimuthally or both with one or more receivers placed axially, azimuthally or both around the core for estimating various acoustic properties of the core. The azimuthal measurements may be made by azimuthally arranging transmitter-receives around a radial plane. Additionally, acoustic sensors may be arranged to make measurements at selected angles between the axial planes. Such measurements may be used to improve or refine the acoustic formation parameters or to enhance arrival times of one set of acoustic signals over another set of acoustic signals. In another aspect an acoustic sensor may be placed in contact with the core 130, such as through an opening in the chamber 124, to estimate the acoustic impedance of the core by evaluating the loading applied on the acoustic transmitter. The acoustic signals from the receivers may be processed by the downhole control unit 180 and/or the surface control unit 40. The downhole processed data may be stored in a memory that may be retrieved to the surface during drilling.

Figure 3:
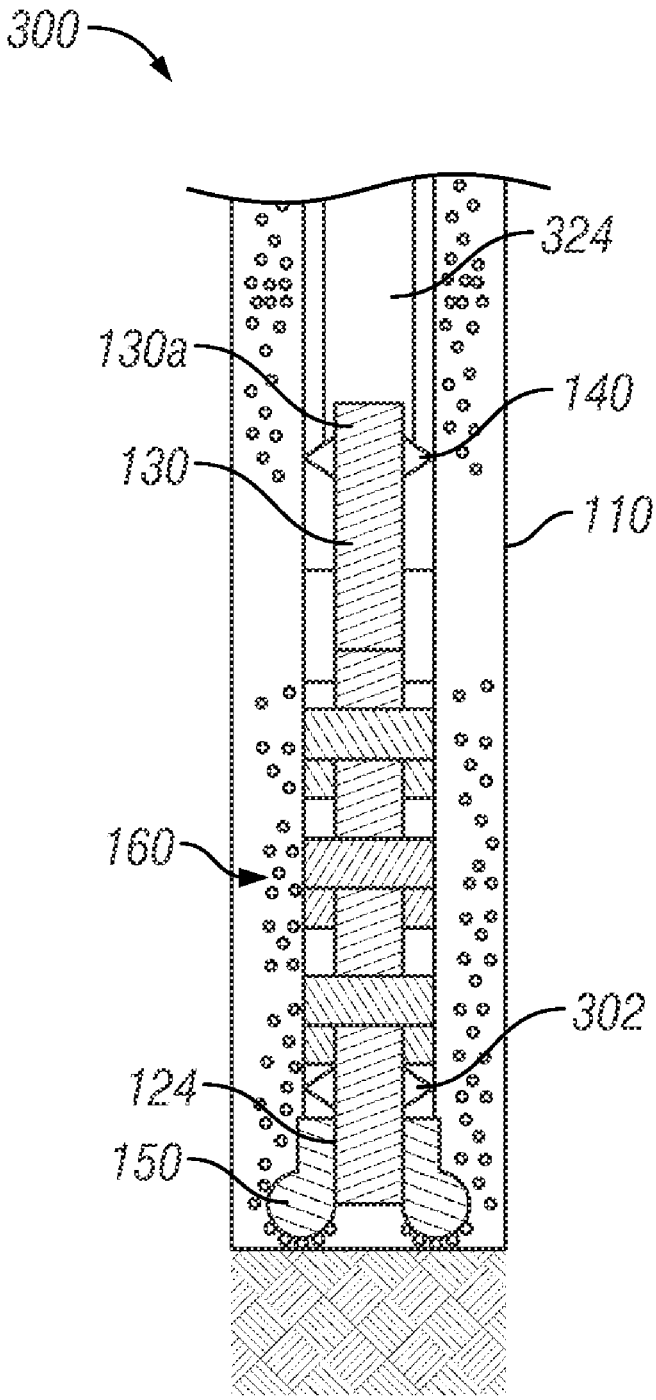
FIG. 3 is a schematic diagram of a portion of a drilling assembly that includes a storage chamber for storing one or more core samples for retrieval to the surface during or after drilling of the wellbore.
Figure 4:
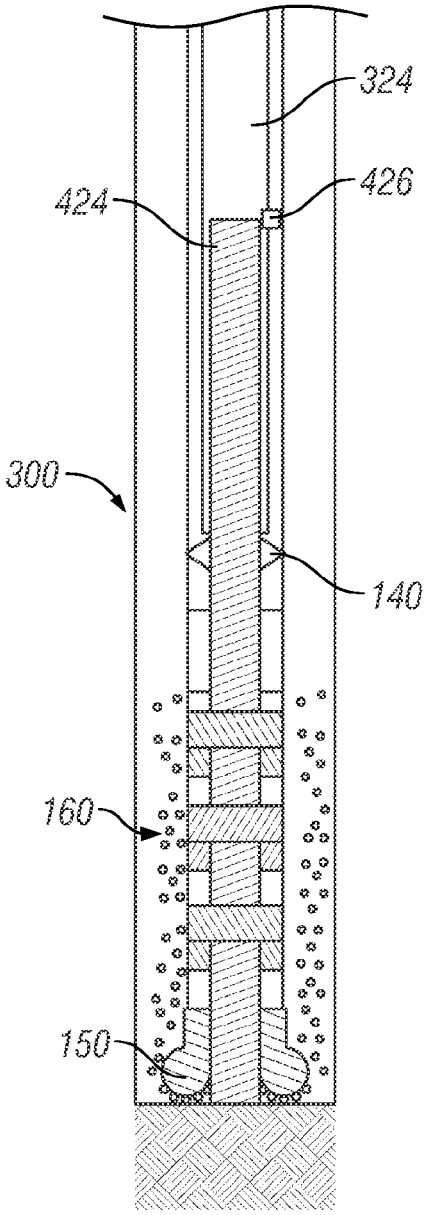
FIG. 4 is a schematic diagram of a portion of a drilling assembly that shows a method of selectively storing core samples in a sample chamber above a core cutting device.
Figure 5:
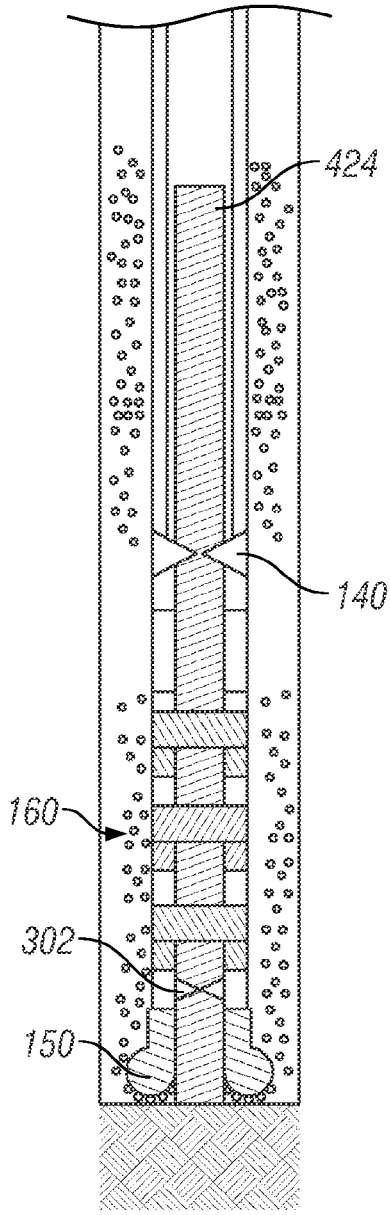
FIG. 5 is a schematic diagram of a portion of a drilling assembly showing a manner of continuing to perform coring and core analysis after a selected sample has been stored in the core sample chamber shown in FIG. 4.

FIGS. 3 and 4 are schematic diagrams of a portion 300 of a drilling assembly 120 that includes a storage chamber for storing one or more core samples for retrieval during or after drilling of the wellbore. The configurations of the drilling assembly portion 300 shown in FIGS. 3 and 4 are the same, each including a core storage chamber 324 above the cutting device 140. FIG. 3 illustrates the cutting device 140 in a retracted position to allow the core 130 to enter into the core storage chamber 324. A sensor 426 may be provided to determine the length of the core 424 in the chamber 324. Once a desired core length has been stored in the chamber 324, the controller 180 (FIG. 1A) may cause the cutting device 140 to engage the core 130 and cut the core sample 424 radially from the remaining core, which allows the core chamber 324 to store the core sample 424 therein. As shown in FIG. 5, once the core sample 424 has been stored, the cutting device 140 may be engaged with the core 130 to continue to cut the top portion of core 130, which allows further continuous coring and the interrogation and analysis of the core and formation properties as described above in reference to FIGS. 1, 2, 2A, 2B and 2C.

Additional core samples may be stored in the sample chamber 324 by stopping the cutting device 140 and moving it away from the core barrel to allow the next core sample to enter into the core storage chamber 324. In this manner selected core samples (corresponding to different wellbore depths) may be stored in the chamber 324. The core sample stored in the chamber 324 may be retrieved to the surface by the retrieval device 129 (FIG. 1B). A closure device 302 is shown in an open position in FIG. 3, wherein it allows the core to enter into the core chamber or barrel. In FIG. 5, the closure device 302 is shown in a closed position to prevent the core from entering into the chamber or barrel.

Figure 6A:
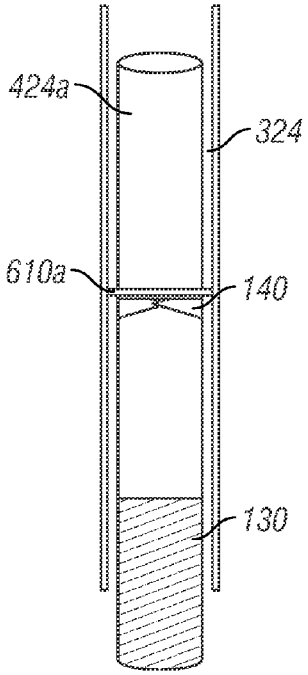
FIG. 6 (comprising FIGS. 6A, 6B and 6C) shows a sequence of collecting multiple core samples according to one aspect of the disclosure.
Figure 6B:
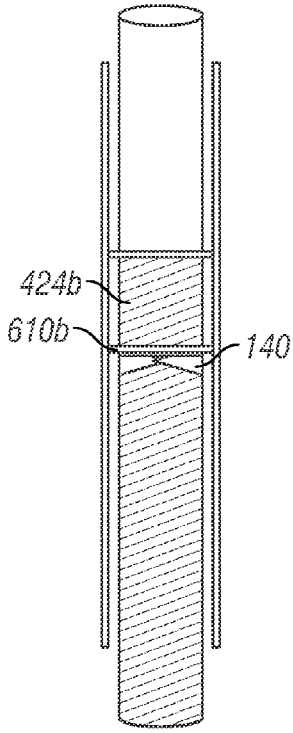
Figure 6C:
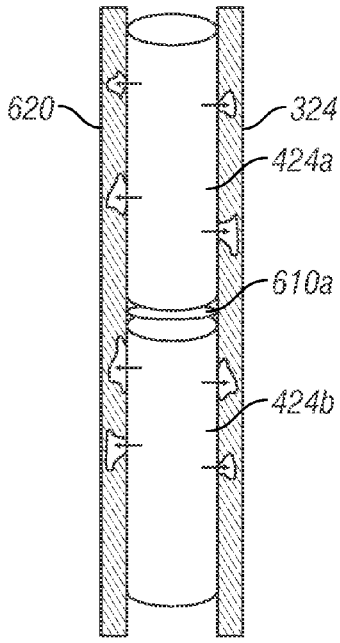

FIG. 6A is a schematic diagram showing the placement of a spacer between the core samples in chamber 324. In one aspect, to identify the location in the wellbore from which a particular sample has been extracted, a spacer 610*a* may be inserted below the first core sample 424*a* after it is cut and stored in the chamber 324. Prior to storing a second sample, the cutting device is disengaged from the core 130, which allows the second sample 424*b* to move into the chamber 324 below the first spacer 610*b*, as shown in FIG. 6B. The second core sample 424*b* is then cut by engaging the cutter 140. A second spacer 610*b* may then be placed below the second sample 424*b*. Additional core samples from different wellbore depths may be stored in the manner described above. The above-described system allows for storing multiple samples from different depths without the removal of a core sample or tripping out the drill string 118. In one aspect, the core storage chamber 324 may be lined with a sponge liner 620, as shown in FIG. 6C. Oil trapped in the core 424*a*, 424*b*, etc. escapes from the core during tripping of the core out of the wellbore 110 and is absorbed by the sponge liner 620.

Figure 7:
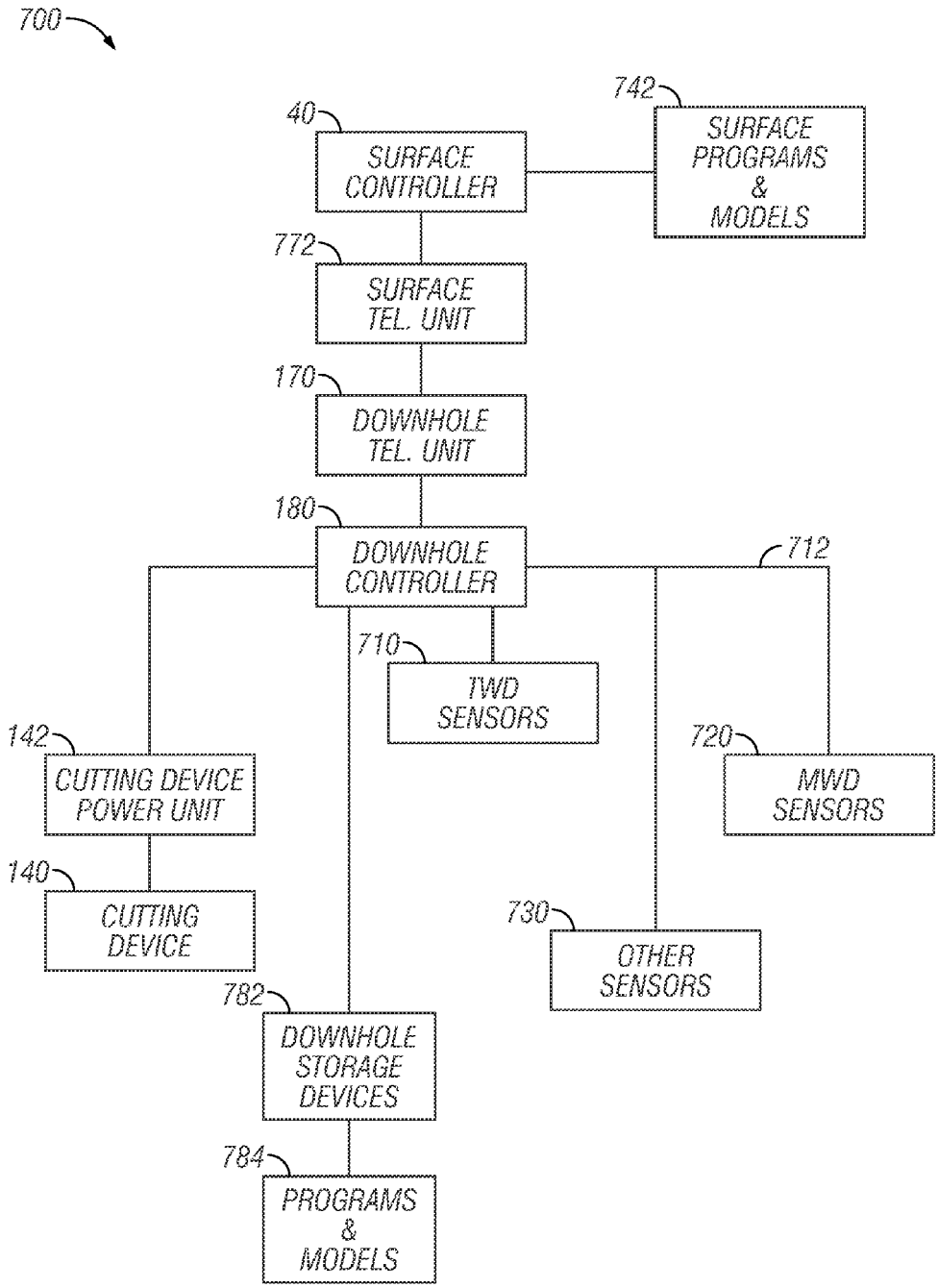
FIG. 7 shows an exemplary functional block diagram of controllers in the system of FIG. 1 for controlling the coring and core analysis functions according to one aspect of the disclosure.

FIG. 7 shows a functional block diagram 700 of a system that may be utilized for controlling the coring operation and estimating the various desired properties of the core and formation. In one aspect, the downhole controller 180 may control the operation of the cutting device power unit 142 to control the cutting operations of the cutting device 140 according to programmed instructions 784 stored in a downhole storage device 782 and/or instructions received from the surface controller 40 via a surface telemetry units 772 and the downhole telemetry unit 170. The downhole controller 180 also may control the operation of the tomography-while-drilling (TWD) sensors 710 (such as sensors 262*a*, 264*a* and 266*a* (FIG. 1B) and MWD/LWD sensors 720, such as sensors 262*b*, 264*b* and 266*b* via a bus 712 according to programs and models stored in the storage device 782 and/or instructions received from the surface controller 40. The downhole controller 180 also may control other downhole sensors 730 in the manner similar to that utilized to control the TWD and MWD/LWD sensors. The downhole controller 180 or surface controller 40 or a combination thereof may process the measurement data obtained from one or more downhole sensors to provide estimates of the various desired properties of the core 130 and the formation 101 and generate two-dimensional or three-dimensional continuous representations of one or more of such properties. The results so generated may be stored in the storage device 782 and/or at the surface storage device 742. Also, some or all of the data processing may be performed by a remote controller in-situ or at a later time.

Thus, in one aspect, a continuous coring method is provided that may include: drilling into a formation to retrieve a core; receiving the core into a chamber at an open end of a chamber; and removing or cutting a portion of the core uphole of the open end of the chamber to allow the chamber to continue to receive the core at the open end as drilling into the formation continues. Removing the portion of the core may be accomplished by any suitable method, including using a mechanical cutting device, such as a side drill bit or mechanical cutting blades, pressurized fluid, a laser cutting device, etc. The method may further include: stopping coring at a first wellbore depth; continuing to drill into the formation to a second depth; removing an end of the core so as to continue to receive additional core into the chamber at the second depth. The method may further include using a sensor to take one or more measurements downhole for estimating a property of interest of the core. The method may further comprise providing a three dimensional map or model of one or more properties of the core. The method may further comprise using a sensor to take a measurements downhole for estimating a property of interest of the formation. The property of interest for the core may be the same or different from the property of interest of the formation.

In another aspect, a coring apparatus is provided that includes: a coring bit for drilling into a formation to retrieve a core; a core barrel uphole of the coring bit for receiving the core therein; a cutting device uphole of the drill bit for cutting or disintegrating a portion of the core at an upper end of the core so that the core barrel may continuously receive the core as the coring bit continues to retrieve the core from the formation. In one aspect, the core barrel is contained within a drilling assembly attached to a bottom end of a drilling tubular. The cutting device may be any suitable device, including, but not limited to, a mechanical cutting device, such as a metallic blades or a side cutting bit, a device that injects high pressure fluid onto the core to cut the core, and a laser device. A power unit provides the power to the cutting device. In one aspect, the apparatus allows continuous coring without the need to store long core samples or the need to retrieve core from the drill sting during drilling of a wellbore.

The apparatus may further include a controller that controls the cutting device. In one aspect, the controller maintains the cutting rate of the core at or greater than the rate of penetration of the coring bit. In another aspect, the cutting device may be set to cut the core at a rate that is equal to or greater than a selected drilling rate of penetration.

In another aspect, an NMR sensor used for estimating an NMR parameter of the core may include: a magnet configured to induce a substantially constant magnetic field in the core; a transmitter coil between the core and the magnet configured to induce an electrical signals into the core at a selected frequency; and a receiver coil spaced apart from the transmitter coil for receiving signals from the core responsive to the induced signals. The magnet and coil may be placed proximate to a non-conductive member between the core and NMR sensor. In another aspect, an NMR sensor used for estimating an NMR parameter of the formation surrounding the core may include: a pair of spaced-apart magnets configured to induce a substantially constant magnetic field in a region of interest of the formation; a transmitter coil configured to induce electrical signals into the region of interest at a selected frequency; and a receiver coil configured to receive signals responsive to the transmitted electrical signals.

In another aspect, an acoustic sensor used for estimating a property of the core may include: at least one transmitter configured to induce acoustic signals into the core, and at least one receiver spaced apart from the at least one transmitter configured to receive acoustic signals from the core that are responsive to the transmitted acoustic signals. The at least one receiver may comprise a first receiver placed radially spaced from the at least one transmitter for estimating an acoustic velocity through the core and a second receiver placed axially from the at least one transmitter for estimating an axial acoustic velocity of the core. An acoustic sensor for estimating a property of the formation may include at least one transmitter configured to transmit acoustic signals into the formation and at least one receiver configured to receive acoustic signals responsive to the transmitted acoustic signals into the formation and wherein the processor provides an estimate of an acoustic property of the formation based on the received acoustic signals. In another aspect, an acoustic sensor may be configured to contact the core for estimating an acoustic impedance of the core. In another aspect, any sensor may be placed proximate to a drill bit attached to a bottom end of the bottomhole assembly for providing signals for estimating one or more properties of the formation ahead of the drill bit. In one aspect, the formation type, such as shale or sand may be determined by the sensors in the drill bit.

In another aspect, any of the sensors may be housed in a removable package placed proximate to the core. The removable sensor package may include any suitable sensor, including, but not limited to: (i) an electrical sensor; (ii) an acoustic sensor; (iii) a nuclear sensor; (iv) a nuclear magnetic resonance sensor; (v) a pressure sensor; (vi) an x-ray sensor; and (vii) a sensor for estimating one of a physical property and a chemical property of the core.

In another aspect, a method for estimating a property of interest downhole may include: receiving a core at a receiving end of a downhole tool while removing a portion of the received core distal from the receiving end of the downhole tool; inducing a substantially constant magnetic field in the core; transmitting electrical signals into the core at a selected frequency by a coil placed between the core and the magnet; receiving signals responsive to the transmitted electrical signals from the core; and processing the received signals to provide an estimate of a property of interest of the core. In another aspect, a method for estimating a property of interest may include: transmitting a current field into the core through a one of a magnetic, galvanic, and capacitive coupling; receiving signals responsive to the transmitted current field from the core through one of the magnetic, galvanic and capacitive coupling; and processing the received signals to provide an estimate of a property of interest. In another aspect, a method may include: transmitting acoustic signals into the core during continuous coring; receiving acoustic signals responsive to the transmitted acoustic signals from the core; and processing the received signals to provide an estimate of a property of the core. In one aspect, the acoustic sensor may include at least a portion that contacts the core for estimating an acoustic impedance of the core. The property of interest may include one or more of: (i) porosity; (ii) permeability; (iii) dielectric constant; (iv) resistivity; (v) a nuclear magnetic resonance parameters; (vi) an oil-water ratio; (vii) an oil-gas ratio; (viii) a gas-water ratio; (ix) a composition of the core or formation; (x) pressure; (xi) temperature; (xi) wettability; (xii) bulk density; (xiii) acoustic impedance; (xiv) acoustic travel time; and (xv) a mechanical parameter. The sensor may be one of: (i) a resistivity sensor; (ii) an acoustic sensor; (iii) a gamma ray sensor; (iv) a pressure sensor; (v) a temperature sensor; (vi) a vibration sensor; (vii) a bending moment sensor; (viii).a hardness sensor; (ix) a neutron sensor; and (x) a compressive strength sensor.

While the foregoing disclosure is directed to certain embodiments that may include certain specific elements, such embodiments and elements are shown as examples and various modifications thereto apparent to those skilled in the art may be made without departing from the concepts described and claimed herein. It is intended that all variations within the scope of the appended claims be embraced by the foregoing disclosure.

What is claimed is:

1. An apparatus for use in a wellbore, comprising:

a core chamber configured to receive a core being drilled from a formation at a receiving end of the core chamber;

a storage chamber uphole of the core chamber configured to store a core sample;

a cutting device configured to cut the core at a location below the storage chamber thereby forming the core sample from the core that has been received by the storage chamber; and a closure device proximate to the receiving end of the core chamber that in a first position allows the core to enter into the core chamber and in a second position prevents the core from entering into the core chamber.

2. The apparatus of claim 1, wherein the cutting device is selected from a group consisting of: (i) a mechanical cutting device; and (ii) a device that uses fluid under pressure to cut the core.

3. The apparatus of claim 1 further comprising a drilling assembly that encloses the core chamber and has a drill bit that is configured to cut the core.

4. The apparatus of claim 1, wherein the storage chamber is lined with a foam member for absorbing fluids contained in the core.

5. The apparatus of claim 1, wherein the cutting device is configured to engage the core in a first mode and disengage from the core in a second mode.

6. The apparatus of claim 1, wherein the cutting device removes a top end of the core to enable the core chamber to continuously receive the core therein during cutting of the core.

7. The apparatus of claim 1 further comprising at least one sensor configured to provide signals relating to a property of interest of one of (i) the core; (ii) an earth formation; and (iii) the wellbore.

8. The apparatus of claim 1, further comprising a controller that is configured to control operation of the cutting device.

9. The apparatus of claim 1, further comprising a conveying member attached to the apparatus for conveying the apparatus into a wellbore.

10. A method of coring, comprising the following sequential steps:

conveying a drilling assembly having a drill bit at an end thereof to a selected depth in a wellbore;

drilling through a rock formation to obtain the core;

receiving the core into a first chamber via an open end of the first chamber;

receiving the core into a second chamber uphole of the first chamber;

cutting a section of the core at a location distal from the open end of the first chamber thereby forming a sample to be retained and stored in the second chamber;

storing the sample of the core in the second chamber closing the open end of the first chamber; and drilling the wellbore to a second depth.

11. The method of claim 10, wherein cutting the section of the core comprises using one of a: (i) fluid under pressure to cut the section of the core; and (ii) mechanical cutter to cut the section of the core.

12. The method of claim 10 further comprising lining the second chamber with a foam member for absorbing fluids from the cut section.

13. The method of claim 10 further comprising:

drilling a second core from the formation at the second depth; and receiving the second core into the first chamber.

14. The method of claim 13 further comprising placing a separator between the first cut section and a second section prior to receiving the second core section into the second chamber.

15. A method of continuous coring, comprising the following sequential steps:

cutting a continuous core from a rock formation;

receiving the continuous core in a coring chamber at an open end thereof;

receiving a core section of the continuous core in a storage chamber uphole of the coring chamber;

removing the continuous core extending beyond a selected distance from the open end of the coring chamber to create a sample comprising the core section;

storing the core section in the storage chamber;

continuing to cut the continuous core and continuing to receive the continuous core in the coring chamber.

16. The method of claim 15, wherein removing the continuous core comprises cutting the continuous core with a drilling assembly having the coring chamber therein and a drill bit at an end thereof.

* * * * *